US007638018B2

(12) United States Patent
Westerkamp et al.

(10) Patent No.: US 7,638,018 B2
(45) Date of Patent: Dec. 29, 2009

(54) PAPER MACHINE COVERING

(75) Inventors: Arved H. Westerkamp, Dettingen/Ems (DE); John Jeffery, Blackburn (GB); Antony Morton, Ben Rhydding (GB)

(73) Assignee: Voith Patent GmbH, Heidenheim (DE)

( * ) Notice: Subject to any disclaimer, the term of this patent is extended or adjusted under 35 U.S.C. 154(b) by 386 days.

(21) Appl. No.: 11/527,249

(22) Filed: Sep. 26, 2006

(65) Prior Publication Data

US 2007/0077388 A1 Apr. 5, 2007

(30) Foreign Application Priority Data

Sep. 30, 2005 (DE) ..... 10 2005 046 905

(51) Int. Cl.

| | |
|---|---|
| ***D21F 7/08*** | (2006.01) |
| ***B32B 3/14*** | (2006.01) |
| ***B32B 3/18*** | (2006.01) |
| ***B32B 5/14*** | (2006.01) |

(52) U.S. Cl. ..... 162/358.2; 162/306; 162/900; 162/901; 428/55; 428/196; 428/204; 428/206; 428/212; 442/281

(58) Field of Classification Search ..... 162/116, 162/348, 358.1, 358.2, 361, 900–904, 358.3, 162/358.4, 306; 428/55, 58, 195.1, 196, 428/206, 53, 54, 56, 204, 212, 217; 442/275, 442/277, 281

See application file for complete search history.

(56) References Cited

U.S. PATENT DOCUMENTS

| | | | | |
|---|---|---|---|---|
| 6,116,156 | A * | 9/2000 | Schiel et al. | 100/118 |
| 6,605,188 | B2 * | 8/2003 | Hagfors et al. | 162/306 |
| 6,736,939 | B2 * | 5/2004 | Watanabe | 162/358.3 |
| 2004/0127126 | A1 * | 7/2004 | Davis | 442/181 |
| 2004/0154776 | A1 * | 8/2004 | Inoue | 162/358.1 |
| 2005/0098293 | A1 * | 5/2005 | Inoue et al. | 162/358.2 |
| 2006/0198996 | A1 | 9/2006 | Morton | |

* cited by examiner

*Primary Examiner*—Eric Hug
(74) *Attorney, Agent, or Firm*—Taylor & Aust, P.C.

(57) ABSTRACT

A covering for a machine for the production of a fibrous web has, at least in some sections, a two-dimensional structure which is formed by a multiplicity of polymer-based regions which differ from each other at least in part by virtue of a different fraction of filler material and/or by virtue of a different type of filler material.

42 Claims, 2 Drawing Sheets

PAPER MACHINE COVERING

BACKGROUND OF THE INVENTION

1. Field of the Invention

This invention relates to a covering for a machine for the production of a fibrous web, which can be in particular a paper web, paperboard web or tissue web. Hence the covering can be in particular a paper machine covering.

2. Description of the Related Art

Particularly press belt basic structures are expensive to manufacture. To ensure the desired physical and mechanical properties, these structures normally include a woven basic structure with a fiber fleece which is fastened to the basic structure by pinning.

What is needed in the art is an improved covering of the type initially referred to. At the same time it should be possible to manufacture this covering in an easier and accordingly cheaper manner.

SUMMARY OF THE INVENTION

According to an embodiment of the present invention, the covering has, at least in some sections, a two-dimensional structure which is formed by a multiplicity of polymer-based regions which differ from each other at least in part by virtue of a different fraction of filler material and/or by virtue of a different type of filler material.

In this case the two-dimensional structure can include at least one polymer layer with structured regions.

The two-dimensional structure can include several polymer layers, each including structured regions.

In this case a part of the structured regions can also be free of filler material, at least essentially.

It is expedient for at least a part of the filler material contained in the structured regions in question to be provided in particle form.

Also, it is advantageous in particular for at least a part of the filler material contained in the structured regions in question to be in fiber form.

The filler material contained in the structured regions in question can include in particular plastic or natural material.

According to another embodiment of the present invention, at least a part of the filler material contained in the structured regions in question includes glass, metal, nanoparticles and/or carbon, in particular in the form of nanotubes.

The fibrous materials of various type differ from each other advantageously in respect of their hardness and/or in respect of their form.

The two-dimensional structure is reinforced at least in some regions by the filler material.

It is advantageous for at least one defined property of the two-dimensional structure to be established by way of the ratio between the fraction of polymer material and the fraction of filler material. Therefore, to obtain certain properties of the two-dimensional structure it is possible to select the ratio between the fraction of polymer material and the fraction of filler material accordingly.

In this case the property in question is defined by way of the ratio between the total fraction of the two-dimensional structure of polymer material and the total fraction of this two-dimensional structure of filler material.

Using the ratio between the fraction of polymer material and the fraction of filler material it is possible to define in particular a mechanical property, such as the tensile modulus and/or the bending modulus of the two-dimensional structure or the covering material.

According to another embodiment of the present invention, the density of the polymer material varies in the transverse direction.

It is also an advantage in particular for the polymer material to be applied onto one side, at least in some sections. Such embodiments on which the polymer material is applied to two sides, at least in some sections, are also possible however.

According to another embodiment of the present invention, provision is made for a grid-type two-dimensional structure.

The polymer material is applied at least partly by extrusion.

The thickness or height of a respective structured region lies in a range from around 0.01 to around 3 mm.

It is expedient for the width of a respective structured region to lie in a range from around 0.2 to around 20 mm and preferably in a range from around 5 to around 10 mm, whereby the width of a respective structured region is preferably around 5 mm.

Also, it is possible and expedient to provide one or more fiber fleece layers.

According to another embodiment of the present invention, the fraction of filler material and/or the type of filler material varies in the transverse direction, meaning transversely with respect to the running direction of the covering.

Alternatively or in addition to this, the fraction of filler material and/or the type of filler material can also vary in the running direction of the covering.

Alternatively or in addition to this, it is also possible for the fraction of filler material and/or the type of filler material to vary in the thickness direction.

Provision is made for at least two polymer layers which are arranged one above the other and have, looking in the transverse direction, a comparable distribution of filler material fractions or filler material types. In this case the two polymer layers can be aligned with each other in the transverse direction or be offset relative to each other in the transverse direction with respect to their distribution of filler material fractions or filler material types.

The regions with a larger filler material fraction alternate with the regions with a smaller filler material fraction or no filler material in the two polymer layers in the transverse direction.

According to another embodiment of the present invention, the two polymer layers are offset relative to each other in the transverse direction by one structured region with respect to their distribution of filler material fractions or filler material types. Such embodiments on which the two polymer layers are aligned, looking in the transverse direction, opposite to each other with respect to their distribution of filler material fractions or filler material types are also possible however.

In certain cases it can be an advantage for an intermediate layer to be provided between two polymer layers. It is possible and expedient for the intermediate layer in question to be a bearing layer or a dampening or cushioning layer. The intermediate layer can be woven.

A polymer layer can form an intermediate layer in this case. Alternatively or in addition to this, a polymer layer can form the layer which can be brought into contact with the material web.

According to another embodiment of the present invention, provision is made for at least two polymer layers, which are arranged one above the other and overlap with each other at least in some sections, or structured regions which overlap with each other.

It is also an advantage in particular for the polymer material to be applied onto or into various sections extending in the same direction.

According to another embodiment of the present invention, a defined transverse property profile of the two-dimensional structure can be preselected by way of accordingly different filler material fractions and/or accordingly different filler material types. In this case the preselectable transverse property profile of the two-dimensional structure can be selected in particular such that a certain transverse property profile of the machine being used to produce the fibrous web, for example a paper machine, is at least essentially compensated.

Hence it is possible, for example, by way of corresponding profiling in the transverse direction to correct or compensate the variations which typically arise on a paper machine and are accompanied by non-uniform dewatering, which can be owed to non-uniformities in respect of the roller hardness, roller wear, roller profiling and/or camber for example.

The covering of the invention can be in particular a press belt or a transfer belt.

Hence it is possible, for example, for a conventional basic fabric of a press belt to be replaced by a two-dimensional structure which is reinforced by the inclusion of a filler material in particle form or fiber form for example.

A press belt, for example, is exposed during operation to mechanical forces x in the belt running direction, y in the transverse direction and z in the thickness direction.

The physical properties of the belt material decide how the structure behaves in response to the arising mechanical forces. These properties include the tensile modulus and the bending modulus.

It is possible, for example, for one or more accordingly reinforced polymer layers to be used in combination with one or more fiber fleece layers for the production of a press belt for example. The final mechanical properties of the structure can be established by way of the fraction of polymer material and the fraction of reinforcement material.

An advantage of the two-dimensional structure according to the invention is, for example, the possibility of accordingly preselecting a property profile of the structure in the transverse direction by using different filler material types and/or different filler material fractions or quantities for compensation of the inherent transverse property profiles of the paper machine.

For example, at least one load-bearing structure in a paper machine covering can be replaced by the two-dimensional polymer structure of the invention in order to improve the properties of said covering.

During the production of a respective covering it is now possible for the respective properties in the machine running direction, transverse direction and/or thickness direction to be controlled or regulated exactly in the desired manner. Even a crisscross pattern can be created if required. In certain cases it may well be expedient to use at least one load-bearing carrier structure as well. However, it is also possible to apply the two-dimensional structure in question directly onto a fiber fleece, which particularly in the case of coverings for narrow, slow machines is possible without further action.

With the reduction in the number of load-bearing basic fabrics the covering becomes more flexible, which is also an advantage in particular during installation. Also, the covering is less inclined to mark the paper sheet, which is always essential when a certain paper quality needs to be assured.

Furthermore, it is possible to save on fiber fleece. With less fiber fleece required to cover the surface, the weight of the covering can be reduced accordingly or its flexibility during installation increased accordingly.

The filler material can be varied with regard to hardness, density and/or form for example such that certain results are achieved with respect to such properties as elasticity, flexibility, ductility or tear resistance for example. Such variability of the properties created during production means that at every point of the covering it is possible to guarantee the desired properties in order, for example, to ensure a good detachment of the fibrous web after a respective nip or after a respective transfer point.

BRIEF DESCRIPTION OF THE DRAWINGS

The above-mentioned and other features and advantages of this invention, and the manner of attaining them, will become more apparent and the invention will be better understood by reference to the following description of (an) embodiment(s) of the invention taken in conjunction with the accompanying drawing(s), wherein.

Figure 1:
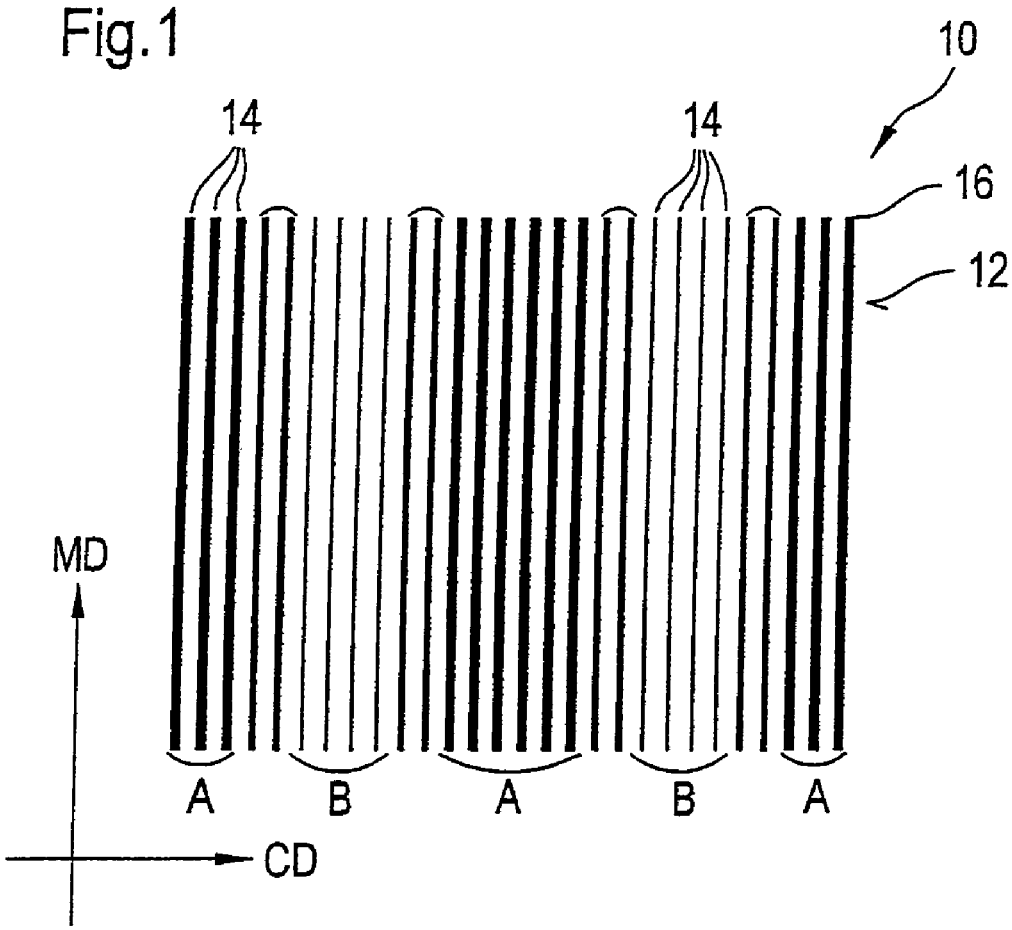
FIG. 1 is a schematic plan view of a section of a covering according to the present invention with a distribution of filler material that is variable across the width.

Corresponding reference characters indicate corresponding parts throughout the several views. The exemplification (s) set out herein illustrate(s) one preferred embodiment of the invention, in one form, and such exemplification(s) (is) (are) not to be construed as limiting the scope of the invention in any manner.

DETAILED DESCRIPTION OF THE PREFERRED EMBODIMENT

Referring now to the drawings, and more particularly to FIG. 1, there is shown, in a schematic plan view, a section of a polymer layer 16 of a covering 10, which can be in particular a paper machine covering.

The covering 10 has a two-dimensional structure 12 which is formed by a multiplicity of polymer-based regions which on the embodiment under consideration differ from each other at least in part by virtue of a different filler material fraction.

In the case under consideration the result is a defined distribution of filler material in the transverse direction CD of the polymer layer 16, meaning across the width of the covering 10.

As is evident from FIG. 1, the results in the case under consideration are linear regions 14 which extend respectively in the machine running direction MD or running direction of the covering and differ from each other by virtue of a different filler material fraction.

For example, the structured regions 14 in the sections A each have a larger filler material fraction or a higher filler material density while the regions in the sections B each have a smaller filler material fraction or a lower filler material density in comparison.

The two-dimensional structure 12 can be applied onto one side, for example, or onto two sides. It can also be applied into the covering, meaning that it lies at least partly inside the covering.

Hence the density of the applied polymer material or the filler material fraction in this polymer material can be controlled or regulated and thus varied across the width of the covering or machine. The polymer material can be applied by extrusion for example. The material can be applied onto one side or onto two sides.

In particular for a press belt it is possible for the height or thickness of a respective structured region 14 to lie in particular in a range from around 0.01 to around 3 mm and for the width of a respective structured region 14 to lie in particular in a range from around 0.2 to around 20 mm and preferably in a range from around 5 to around 10 mm. A preferred width of a respective structured region 14 is around 5 mm.

The distribution of the filler material fraction or filler material density can vary in transverse direction, in thickness direction and/or in the running direction of the covering. The same applies also for the type of filler material if required.

Figure 2:
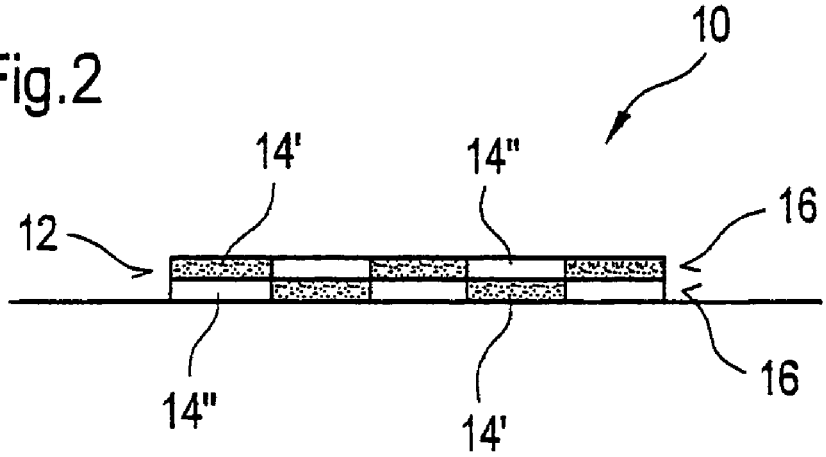
FIG. 2 is a schematic cross sectional representation of a covering which includes two polymer layers, each equipped with filler material in some regions.

FIG. 2 shows, in a schematic cross sectional representation, a covering 10 which includes two polymer layers 16, each equipped with filler material in some regions.

In this case, each of these two polymer layers 16 has successive regions 14', 14" with filler material and without filler material respectively.

As is evident from FIG. 2, the two polymer layers 16, which are arranged one above the other, have a comparable distribution of filler material fractions looking in the transverse direction. In the case under consideration, the two polymer layers 16 are offset relative to each other in the transverse direction with respect to this distribution of filler material fractions. Hence there is always a structured region 14' with filler material above a structured region 14" without filler material or vice versa.

Figure 3:
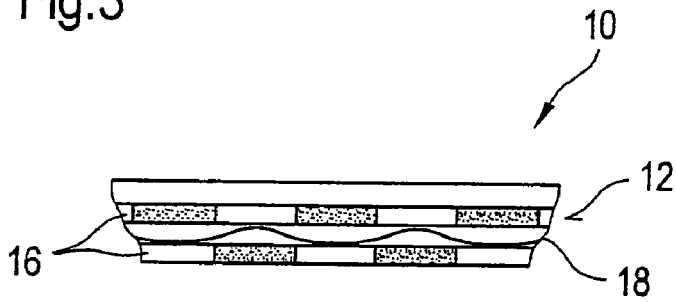
FIG. 3 is a schematic cross sectional representation of a section of a covering according to the present invention including several polymer layers, whereby provision is made between two such polymer layers for a, for example, woven intermediate layer.

FIG. 3 shows, in a schematic cross sectional representation, a section of a covering 10 including several polymer layers 16, whereby in the case under consideration provision is made between two such polymer layers 16 for a, for example, woven intermediate layer 18.

Illustrated in FIG. 3 as well as in FIG. 1 is the use of a two-dimensional structure 12 in a press belt for example. In this case at least one reinforcing base layer for example, such as a woven layer or a non-woven layer for example, such as a reinforced membrane for example, can be replaced by the two-dimensional structure of the invention, which, as already mentioned, can be applied onto or into said structure by extrusion for example.

The use of an intermediate layer 18 shown in FIG. 3 by way of example is possible not only on a press belt but also on a transfer belt for example.

Figure 4:
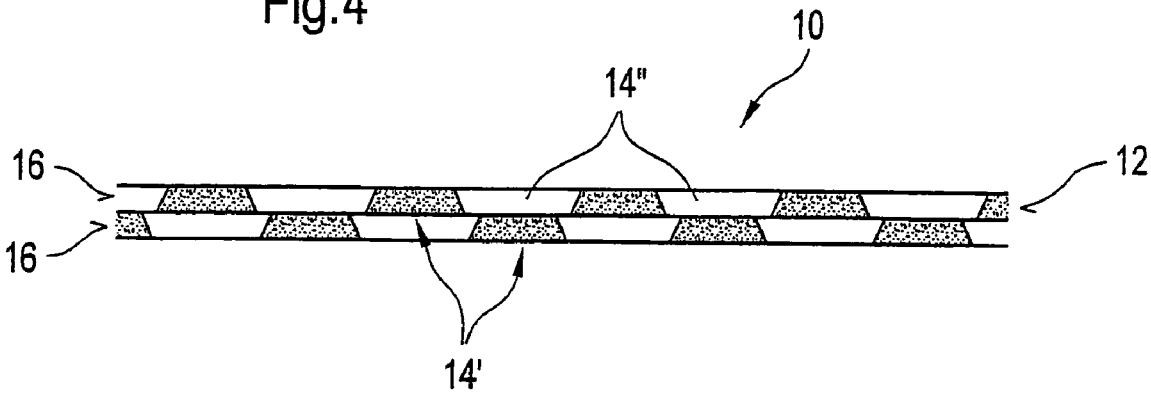
FIG. 4 is a schematic cross sectional representation of a section of a covering according to the present invention including several polymer layers overlapping each other or structured regions overlapping each other.

FIG. 4 shows, in a schematic cross sectional representation, a section of a covering 10 including several polymer layers 16 overlapping each other or structured regions 14', 14" overlapping each other. As is evident from FIG. 4, the two-dimensional structure 12 in question includes structured regions 14' with filler material and structured regions 14" without filler material overlapping each other.

Such a construction is suitable in particular for a transfer belt, in which case the upper polymer layer 16 in FIG. 4 forms the paper side of the transfer belt. The use of such a structure on a press belt is also possible however.

The embodiments shown in FIG. 4 as well as in FIG. 2 demonstrate how a two-dimensional structure in question can be used to change and improve the properties of a press belt or transfer belt. With polymer, for example polyurethane or the like, applied onto at least one side, the results, compared to conventional belts with a woven or composite-based substrate, are advantages in particular with respect to suppleness, elasticity and flexibility.

From FIG. 4 it is also evident in particular how the polymer layers or structured regions 14', 14" can overlap each other in order to lend the structure a corresponding strength before the filler material is added.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claim

LIST OF REFERENCE NUMERALS

10 Covering
12 Two-dimensional structure
14 Structured region
14' Structured region with filler material
14" Structured region without filler material
16 Polymer layer
18 Intermediate layer
CD Transverse direction
MD Machine running direction

What is claimed is:

1. A covering for a machine for the production of a fibrous web, said covering comprising a plurality of sections of the covering, at least some of said plurality of sections including a two-dimensional structure including at least two polymer layers arranged one above the other and each including a plurality of polymer-based regions, said plurality of polymer-based regions of each respective said polymer layer differing from each other at least in part by virtue of at least one of a different fraction of a filler material and a different type of said filler material, said polymer layers being offset relative to each other in a transverse direction of the covering with respect to a distribution of one of fractions of said filler material and types of said filler material.

2. The covering according to claim 1, wherein said plurality of polymer-based regions are a plurality of structured regions.

3. The covering according to claim 2, wherein each of said polymer layers has said filler material in some of said plurality of structured regions.

4. The covering according to claim 2, wherein at least a part of said plurality of structured regions is at least essentially free of said filler material.

5. The covering according to claim 2, wherein at least a part of said filler material is contained in said plurality of structured regions, said at least a part of said filler material having a particle form.

6. The covering according to claim 2, wherein at least a part of said filler material is contained in said plurality of structured regions and has a fiber form.

7. The covering according to claim 6, wherein said filler material comprises a plurality of fibrous materials, said plurality of fibrous materials differing from each other in respect of at least one of a hardness and a form.

8. The covering according to claim 2, wherein at least a part of said filler material is contained in said plurality of structured regions, said at least a part of said filler material comprised of a plastic.

9. The covering according to claim 2, wherein at least a part of said filler material is contained in said plurality of structured regions, said at least a part of said filler material comprised of a natural material.

10. The covering according to claim 2, wherein at least a part of said filler material is contained in said plurality of structured regions, said at least a part of said filler material comprised of at least one of a glass, a metal, a plurality of nanoparticles, and a plurality of carbon nanotubes.

11. The covering according to claim 2, wherein one of a thickness and a height of each said plurality of structured regions lies in a range from around 0.01 mm to around 3 mm.

12. The covering according to claim 2, wherein a width of each said plurality of structured regions lies in a range from around 0.2 mm to around 20 mm.

13. The covering according to claim 2, wherein a width of each said plurality of structured regions lies in a range from around 5 mm to around 10 mm.

14. The covering according to claim 2, wherein said at least two plurality of polymer layers arranged one above the other have, in said transverse direction of the covering, a comparable said distribution of one of fractions of said filler material and types of said filler material.

15. The covering according to claim 14, wherein said plurality of structured regions comprise a plurality of regions having a larger fraction of said filler material and a plurality of regions having at least one of a smaller fraction of said filler material and no said filler material, in said transverse direction each said plurality of regions having a larger fraction of said filler material alternating with each said plurality of regions having at least one of a smaller fraction of said filler material and no said filler material.

16. The covering according to claim 14, wherein in said transverse direction said at least two said plurality of polymer layers are offset relative to each other by one of said plurality of structured regions with respect to said distribution for each said at least two said plurality of polymer layers.

17. The covering according to claim 14, wherein said at least two said plurality of polymer layers have therebetween an intermediate layer comprising one of a dampening layer or a cushioning layer.

18. The covering according to claim 2, wherein at least two said plurality of polymer layers have therebetween an intermediate layer.

19. The covering according to claim 18, wherein said intermediate layer comprises a bearing layer.

20. The covering according to claim 18, wherein said intermediate layer comprises a woven layer.

21. The covering according to claim 2, wherein said plurality of structured regions comprise a plurality of regions having a larger fraction of said filler material and a plurality of regions having at least one of a smaller fraction of said filler material and no said filler material, at least two said plurality of polymer layers are arranged one above the other, said at least two of said plurality of polymer layers one of overlap with each other at least in some sections of the covering and said plurality of regions having a larger fraction of said filler material and said plurality of regions having at least one of a smaller fraction of said filler material and no said filler material overlap with each other.

22. The covering according to claim 1, wherein said two-dimensional structure reinforced at least in some said polymer-based regions by said filler material.

23. The covering according to claim 1, wherein said two-dimensional structure comprises a polymer material, said two-dimensional structure having at least one property defined by a ratio between a fraction of said polymer material and a fraction of said filler material.

24. The covering according to claim 23, wherein said two-dimensional structure has at least one of a tensile modulus and a bending modulus, said at least one of a tensile modulus and a bending modulus defined using said ratio.

25. The covering according to claim 1, wherein said two-dimensional structure comprises a polymer material, said two-dimensional structure having at least one property, said at least one property defined by a ratio between a total fraction of said polymer material of said two-dimensional structure and a total fraction of said filler material of said two-dimensional structure.

26. The covering according to claim 1, wherein said two-dimensional structure comprises a polymer material, said two-dimensional structure having at least one mechanical property defined using a ratio between a fraction of said polymer material and a fraction of said filler material.

27. The covering according to claim 1, wherein said two-dimensional structure comprises a polymer material, a density of said polymer material varies in said transverse direction of the covering.

28. The covering according to claim 1, further comprising a side of the covering, wherein said two-dimensional structure comprises a polymer material, wherein at least in some of said sections of the covering said polymer material is applied onto one said side of the covering.

29. The covering according to claim 1, further comprising two sides of the covering, wherein said two-dimensional structure comprises a polymer material, wherein at least in some of said sections of the covering said polymer material is applied onto two said sides of the covering.

30. The covering according to claim 1, wherein said two-dimensional structure has a type, said type being a grid.

31. The covering according to claim 1, wherein said two-dimensional structure comprises a polymer material, said polymer material is applied at least partly by extrusion.

32. The covering according to claim 1, a width of each said plurality of structured regions is around 5 mm.

33. The covering according to claim 1, further comprising at least one fiber fleece layer.

34. The covering according to claim 33, further comprising a plurality of fiber fleece layers.

35. The covering according to claim 1, wherein at least one of a fraction of said filler material and a type of said filler material vary in said transverse direction of the covering.

36. The covering according to claim 1, wherein at least one of a fraction of said filler material and a type of said filler material vary in a running direction (MD) of the covering.

37. The covering according to claim 1, wherein at least one of a fraction of said filler material and a type of said filler material vary in a thickness direction of the covering.

38. The covering according to claim 1, wherein said two-dimensional structure comprises a polymer material, said polymer material applied onto or into said plurality of sections of the covering, said sections extending in the same direction.

39. The covering according to claim 1, wherein said two-dimensional structure comprises a transverse property profile defined by at least one of different fractions of said filler material and different types of said filler material.

40. The covering according to claim 39, wherein said transverse property profile is such that a certain transverse property profile of the machine being used to produce the fibrous web is at least essentially compensated.

41. The covering according to claim 1, wherein the covering is a press belt.

42. The covering according to claim 1, wherein the covering is a transfer belt.

* * * * *